US011053786B1

(12) United States Patent
Nguyen et al.

(10) Patent No.: US 11,053,786 B1
(45) Date of Patent: Jul. 6, 2021

(54) METHODS FOR ENHANCING AND MAINTAINING EFFECTIVE PERMEABILITY OF INDUCED FRACTURES

(71) Applicant: Halliburton Energy Services, Inc., Houston, TX (US)

(72) Inventors: Philip D. Nguyen, Houston, TX (US); Ronald Glen Dusterhoft, Katy, TX (US); Paul M. Ashcraft, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/736,994

(22) Filed: Jan. 8, 2020

(51) Int. Cl.
*E21B 43/263* (2006.01)
*E21B 43/267* (2006.01)
*E21B 33/12* (2006.01)

(52) U.S. Cl.
CPC ..... *E21B 43/263* (2013.01); *E21B 43/267* (2013.01); *E21B 33/12* (2013.01)

(58) Field of Classification Search
CPC ..... E21B 43/263; E21B 43/26; E21B 43/117; E21B 43/11; E21B 43/1185; E21B 43/267; E21B 33/124
See application file for complete search history.

(56) References Cited

U.S. PATENT DOCUMENTS 3,630,284 A * 12/1971 Fast ..... E21B 23/04 166/299
5,355,802 A 10/1994 Petitjean
7,228,906 B2 6/2007 Snider et al.
7,353,866 B2 4/2008 Snider et al.
7,431,075 B2 10/2008 Brooks et al.
7,565,930 B2 7/2009 Seekford
7,950,457 B2 5/2011 Seekford
(Continued)

FOREIGN PATENT DOCUMENTS

WO 2015159304 A2 10/2015
WO 2017075139 A1 5/2017

OTHER PUBLICATIONS

International Search Report and Written Opinion issued in related PCT Application No. PCT/US2020/012838 dated Sep. 28, 2020, 11 pages.

*Primary Examiner* — Zakiya W Bates
(74) *Attorney, Agent, or Firm* — Thomas Rooney; Baker Botts L.L.P.

(57) ABSTRACT

Systems and methods for treating subterranean formations for treating subterranean formations using propellant fracturing and hydraulic fracturing to detonate and inject in sequential stages. A method comprises disposing a propellant fracturing tool downhole into a well bore; introducing a fracturing fluid into a work string coupled to the fluid conduit to pressurize and set an upper packer and a lower packer against the well bore; detonating sequentially a plurality of propellant band stages to produce one or more fractures; introducing sequentially a series of treatment fluids into a well bore penetrating at least a portion of a subterranean formation, wherein the sequential introduction of the series of treatment fluids occurs between the sequential detonation of the plurality of propellant band stages; and depositing at least a portion of the treatment fluids in at least a portion of the subterranean formation.

19 Claims, 4 Drawing Sheets

(56) References Cited

U.S. PATENT DOCUMENTS

| | | | |
|---|---|---|---|
| 8,469,110 | B2 | 6/2013 | Sanders et al. |
| 8,522,863 | B2 | 9/2013 | Tiernan et al. |
| 8,607,704 | B2 | 12/2013 | Stark et al. |
| 8,689,876 | B2 | 4/2014 | Lorree et al. |
| 9,027,641 | B2 | 5/2015 | Alekseenko et al. |
| 9,062,545 | B2 | 6/2015 | Roberts et al. |
| 9,182,207 | B2 | 11/2015 | McPherson et al. |
| 9,447,672 | B2 | 9/2016 | Arrell, Jr. et al. |
| 9,453,402 | B1 | 9/2016 | Barton et al. |
| 9,470,079 | B1 | 10/2016 | Schmidt et al. |
| 9,896,920 | B2 | 2/2018 | Holder et al. |
| 9,995,124 | B2 | 6/2018 | Moore et al. |
| 10,087,734 | B2 | 10/2018 | Fehr et al. |
| 10,113,388 | B2 | 10/2018 | Stewart et al. |
| 10,132,148 | B2 | 11/2018 | Moore et al. |
| 2003/0230406 | A1 | 12/2003 | Lund |
| 2007/0163775 | A1 | 7/2007 | Walton et al. |
| 2008/0271894 | A1 | 11/2008 | Hill et al. |
| 2010/0044047 | A1 | 2/2010 | Kabishcher et al. |
| 2016/0084059 | A1 | 3/2016 | Moore et al. |
| 2016/0153271 | A1 | 6/2016 | Mace et al. |
| 2017/0152432 | A1 | 6/2017 | Vo et al. |
| 2018/0202277 | A1 | 7/2018 | Sawka et al. |
| 2019/0153845 | A1* | 5/2019 | Hunter ..... E21B 43/248 |
| 2019/0383126 | A1 | 12/2019 | Nguyen et al. |

* cited by examiner

METHODS FOR ENHANCING AND MAINTAINING EFFECTIVE PERMEABILITY OF INDUCED FRACTURES

BACKGROUND

The present disclosure relates to systems and methods for treating subterranean formations using propellant fracturing and hydraulic fracturing.

In the production of hydrocarbons from a subterranean formation, the subterranean formation should be sufficiently conductive to permit the flow of desirable fluids to a well bore penetrating the formation. One type of treatment used in the art to increase the conductivity of a subterranean formation is hydraulic fracturing. Hydraulic fracturing operations generally involve pumping a treatment fluid (e.g., a fracturing fluid or a "pad fluid") into a well bore that penetrates a subterranean formation at or above a sufficient hydraulic pressure to create or enhance one or more pathways, or "fractures," in the subterranean formation. These fractures generally increase the permeability and/or conductivity of that portion of the formation. The fluid may comprise particulates, often referred to as "proppant particulates," that are deposited in the resultant fractures. The proppant particulates are thought to help prevent the fractures from fully closing upon the release of the hydraulic pressure, forming conductive channels through which fluids may flow to a well bore.

Generally, fracturing treatment in a rock formation can create single fractures which extend from sides of the well bore. However, it may not be feasible to create such fractures in many carboniferous formations, such as shales, clays, and/or coal beds. These carboniferous formations typically have finely laminated structures that are easily broken down into pieces. Therefore, creating an effective fracture network in these formations is not always feasible using conventional fracturing methods.

Further, hydraulic fracturing currently has sustainability issues. Hydraulic fracturing requires large volumes of water and proppant, is only applicable where water is provided, and creates complex fracture networks where fractures may close-up due to a failure of depositing proppant. Hydraulic fracturing is also applied at high injection rates and pressures. An alternative way to create a facture network would be to use propellant fracturing. Currently, techniques used to employ propellant fracturing provide a short duration of generated pressure to be applied to the subterranean formation, and short fractures are created with a single detonation, in comparison to hydraulic fracturing. There exists a need for improvements in propellant fracturing.

BRIEF DESCRIPTION OF THE DRAWINGS

These drawings illustrate certain aspects of some of the embodiments of the present disclosure and should not be used to limit or define the claims.

Figure 1:
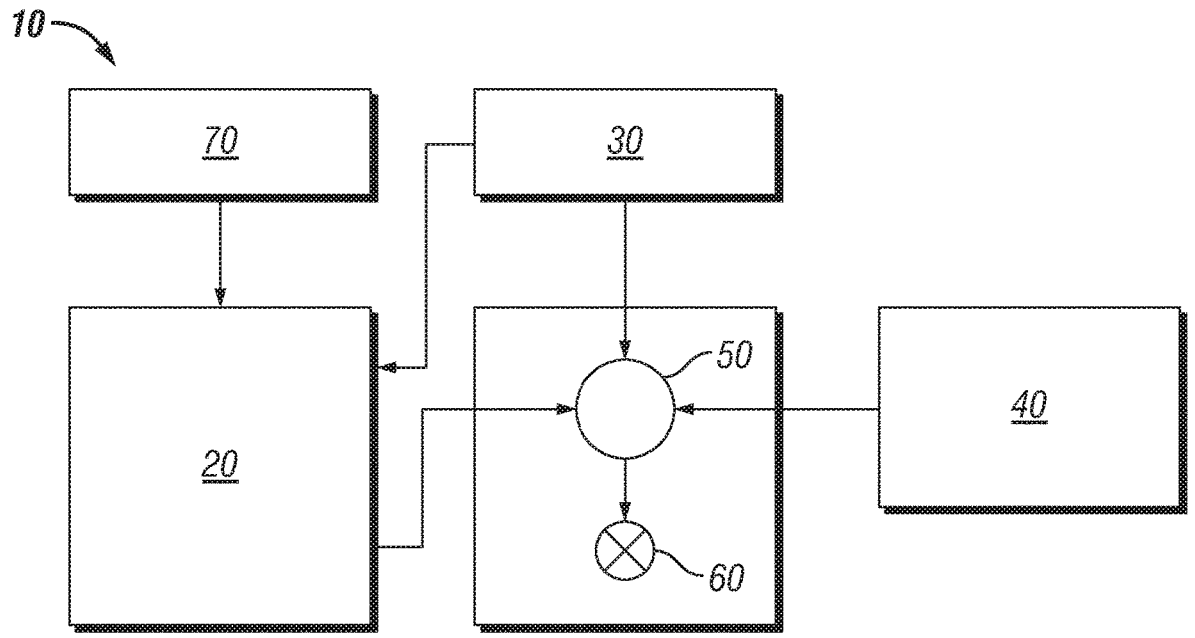
FIG. 1 is a diagram illustrating an example of a fracturing system that may be used in accordance with certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure involving well bores may be applicable to horizontal, vertical, deviated, or otherwise nonlinear well bores in any type of subterranean formation. Embodiments may be applicable to injection wells, monitoring wells, and production wells, including hydrocarbon or geothermal wells.

The methods and systems of the present disclosure may, among other things, enable the creation and/or enhancement of one or more conductive channels and/or enhanced fracture geometries about a subterranean formation. More specifically, the present disclosure provides fracturing systems and methods that introduce stages of proppant-carrying treatment fluid into a subterranean formation in between intermittent detonations of propellant stages. In certain embodiments, high pressure pulses may be generated by detonating propellant stages in order to create one or more fractures. In these embodiments, treatment fluid may be injected in between these detonations, continuously alongside the detonations, and combinations thereof. This may, among other benefits, enable the creation and/or enhancement of more varied fracture geometries and patterns (e.g., secondary/tertiary fractures, branched fractures, dendritic fractures, etc.) in the formation. The treatments fluids may initially comprise reactive agents (for example, acids) and microproppants. As the detonations continue, the treatment fluids may comprise larger-sized particles, such as proppants, as opposed to the microproppants to provide mechanical support for the fractures. In one or more embodiments, the detonation of the propellant stages may initiate fracture generation, and the injection of treatment fluids may extend or propagate fracture length and complexity in the formation. In these embodiments, the propellant stages may be detonated sequentially. Within the present disclosure, embodiments of the applicable treatment fluids followed by the methodology of the propellant fracturing as shown in the figures will be disclosed.

The treatment fluids used in the methods and systems of the present disclosure may comprise any base fluid known in the art, including aqueous fluids, non-aqueous fluids, gases, or any combination thereof. Aqueous fluids that may be suitable for use in the methods and systems of the present disclosure may comprise water from any source, provided that it does not contain compounds that adversely affect other components of the treatment fluid. Such aqueous fluids may comprise fresh water, salt water (e.g., water containing one or more salts dissolved therein), brine (e.g., saturated salt water), formation produced water, seawater, or any combination thereof. In certain embodiments, the density of the aqueous fluid can be adjusted, among other purposes, to provide additional particulate transport and suspension in the compositions of the present disclosure. In certain embodiments, the pH of the aqueous fluid may be adjusted (e.g., by a buffer or other pH adjusting agent) to a specific level, which may depend on, among other factors, the types of gelling agents, acids, and other additives included in the fluid. One of ordinary skill in the art, with the benefit of this disclosure, will recognize when such density and/or pH adjustments are appropriate. Examples of non-aqueous fluids that may be suitable for use in the methods and systems of the present disclosure include, but are not limited to, oils, hydrocarbons, organic liquids, and the like. In certain embodiments, the treatment fluids may comprise a mixture of one or more fluids and/or gases, including but not limited to emulsions, foams, and the like.

The treatment fluids used in the methods and systems of the present disclosure may comprise a plurality of proppants. The proppants used in the methods and systems of the present disclosure may comprise any particulate capable of being deposited in one or more of the fractures in the formation (whether created, enhanced, and/or pre-existing). Examples of proppant particulates that may be suitable for use include, but are not limited to: bubbles or microspheres, such as made from glass, ceramic, polymer, sand, and/or another material. Other examples of proppant particulates may include particles of any one or more of: calcium carbonate ($CaCO_3$); barium sulfate ($BaSO_4$); organic polymers; cement; boric oxide; slag; sand; bauxite; ceramic materials; glass materials; polymer materials; polytetrafluoroethylene materials; nut shell pieces; cured resinous particulates comprising nut shell pieces; seed shell pieces; cured resinous particulates comprising seed shell pieces; fruit pit pieces; cured resinous particulates comprising fruit pit pieces; wood; composite particulates; and combinations thereof. Suitable composite particulates may comprise a binder and a filler material wherein suitable filler materials may include any one or more of: silica; alumina; fumed carbon; carbon black; graphite; mica; titanium dioxide; meta-silicate; calcium silicate; kaolin; talc; zirconia; boron; fly ash; hollow glass microspheres; solid glass; and combinations thereof. In certain embodiments, the proppant particulates may be at least partially coated with one or more substances such as tackifying agents, silyl-modified polyamide compounds, resins, crosslinkable aqueous polymer compositions, polymerizable organic monomer compositions, consolidating agents, binders, or the like.

The proppant particulates may be of any size and/or shape suitable for the particular application in which they are used. In certain embodiments, the proppant particulates used may have a particle size in the range of from about 2 to about 400 mesh, U.S. Sieve Series. In certain embodiments, the proppant may comprise graded sand having a particle size in the range of from about 10 to about 70 mesh, U.S. Sieve Series. Preferred sand particle size distribution ranges may be one or more of 10-20 mesh, 20-40 mesh, 30-50 mesh, 40-60 mesh, 50-70 mesh, or 70-140 mesh, depending on, for example, the fracture geometries of the formation, the location in the formation where the proppant particulates are intended to be placed, and other factors. In certain embodiments, a combination of proppant particulates having different particle sizes, particle size distributions, and/or average particle sizes may be used. In certain embodiments, proppant particulates of different particle sizes, particle size distributions, and/or average particle sizes may be used in different stages of proppant-carrying fluid in a single fracturing operation. For example, earlier stages of proppant-carrying fluid may include smaller proppant particulates that can enter the narrower tip regions of fractures in the formation, while larger proppant particulates may be used in subsequent stages that may be deposited in the fracture without approaching the tip regions.

Proppants may be included in the proppant-carrying treatment fluid in any suitable concentration. In certain embodiments, the concentration of particulates in the proppant-carrying treatment fluid may range from about 0.1 to about 8 lb/gal. In other embodiments, it may range from about 0.5 to about 5.0 lb/gal, and in some embodiments, from about 1.5 to about 2.5 lb/gal. In some embodiments, the concentration of particulates in the proppant-carrying fluid may have an approximate lower range of any one of: 0.5, 0.6, 0.7, 0.8, 0.9, 1.0, 1.1, 1.2, 1.3, 1.4, 1.5, 1.6, 1.7, 1.8, 1.9, and 2.0 lb/gal; and an upper range of approximately any one of: 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6. 3.7, 3.8, 3.9, 4.0, 4.1, 4.2, 4.3, 4.4, 4.5 lb/gal, and so on up to 8.0 lb/gal in increments of 0.1 lb/gal. Thus, the concentration range of particulates of some example embodiments may be from about 0.5 lb/gal to about 1.0 lb/gal, or from about 1.0 lb/gal to about 4.4 lb/gal, or from about 2.0 lb/gal to about 2.5 lb/gal, and so on, in any combination of any one of the upper and any one of the lower ranges recited above (including any 0.1 lb/gal increment between 4.5 and 8.0 lb/gal). A person of skill in the art with the benefit of this disclosure will recognize the appropriate amount of proppants to use in an application of the present disclosure based on, among other things, the type of formation, the particle size of the proppant, the parameters of the fracturing operation, fracture geometries, and the like. In certain embodiments, the proppants may be categorized as microproppants or may generally be inclusive of microproppants.

In certain embodiments, the treatment fluids used in the methods of the present disclosure may include a plurality of microproppant particles, for example, to be placed in microfractures within the subterranean formation. As used herein, the term "plurality" refers in a non-limiting manner to any integer equal or greater than 1. The use of the phrase "plurality of microproppant particles" is not intended to limit the composition of the plurality of microproppant particles or the type, shape, or size, etc. of the microproppant particles within the plurality. For instance, in certain embodiments, the composition of the plurality of microproppant particles may be substantially uniform such that each microproppant particle within the plurality is of substantially similar type, shape, and/or size, etc. In other embodiments, the composition of the plurality of microproppant particles may be varied such that the plurality includes at least one microproppant particle of a particular type, shape, and/or size, etc. and at least one other microproppant particle of a different type, shape, and/or size, etc.

Examples of materials that may be suitable for use as microproppant particles in certain embodiments of the present disclosure include, but are not limited to, fly ash, silica, alumina, fumed carbon (e.g., pyrogenic carbon), carbon black, graphite, mica, titanium dioxide, metal-silicate, silicate, kaolin, talc, zirconia, boron, hollow microspheres (e.g., spherical shell-type materials having an interior cavity), glass, calcined clays (e.g., clays that have been heated to drive out volatile materials), partially calcined clays (e.g., clays that have been heated to partially drive out volatile materials), composite polymers (e.g., thermoset nanocomposites), halloysite clay nanotubes, and any combination thereof. In certain embodiments, microproppant particles may become anchored and/or adhered to fracture faces within the microfracture, which may produce solid masses in the forms of high strength ridges, bumps, patches, or an uneven film on the fracture face. This may, among other benefits, further assist in maintaining the conductivity of the microfractures.

The microproppant particles may be of any shape (regular or irregular) suitable or desired for a particular application. In some embodiments, the microproppant particles may be round or spherical in shape, although they may also take on other shapes such as ovals, capsules, rods, toroids, cylinders, cubes, or variations thereof. In certain embodiments, the microproppant particles of the present disclosure may be relatively flexible or deformable, which may allow them to enter certain perforations, microfractures, or other spaces within a subterranean formation whereas solid particulates of a similar diameter or size may be unable to do so.

In certain embodiments, the plurality of microproppant particles may have a mean particle diameter of about 100 microns or less. In certain embodiments, the plurality of microproppant particles may have a mean particle diameter in a range of from about 0.1 microns to about 100 microns. In one or more embodiments, the plurality of microproppant particles may have a mean particle diameter in a range of from about 0.1 microns to about 50 microns. In one or more embodiments, the plurality of microproppant particles may have a mean particle diameter of about 25 microns or less, in other embodiments, a mean particle diameter of about 10 microns or less, and in other embodiments, a mean particle diameter of about 5 microns or less.

As used herein, the term "diameter" refers to a straight-line segment joining two points on the outer surface of the microproppant particle and passing through the central region of the microproppant particle, but does not imply or require that the microproppant particle is spherical in shape or that it have only one diameter. As used herein, the term "mean particle diameter" refers to the sum of the diameter of each microproppant particle in the plurality of microproppant particles divided by the total number of the microproppant particles in the plurality of microproppant particles. The mean particle diameter of the plurality of microproppant particles may be determined using any particle size analyzer known in the art. In certain embodiments, the mean particle diameter of the plurality of microproppant particles may be determined using a representative subset or sample of microproppant particles from the plurality of microproppant particles. A person of skill in the art with the benefit of the present disclosure will understand how to select such a representative subset or sample of microproppant particles from the plurality of microproppant particles.

In certain embodiments, each of the microproppant particles may have particle sizes smaller than 100 mesh (149 microns), and in certain embodiments may have particle sizes equal to or smaller than 200 mesh (74 microns), 230 mesh (63 microns) or even 325 mesh (44 microns). The size and/or diameter of the microproppant particles may be tailored for a particular application based on, for example, the estimated width of one or more microfractures within a subterranean formation in which the microproppant particles are to be used, as well as other factors. In certain embodiments, the microproppant particles may have a mean particle size distribution less than 100 microns.

In certain embodiments, the microproppant particles may be present in the treatment fluids of the present disclosure in an amount up to about 10 pounds of microproppant particles per gallon of treatment fluid ("ppg"). In certain embodiments, the microproppant particles may be present in the treatment fluids of the present disclosure in an amount within a range of from about 0.01 ppg to about 10 ppg. In one or more embodiments, the microproppant particles may be present in the treatment fluids of the present disclosure in an amount within a range of from about 0.01 ppg to about 0.1 ppg, in other embodiments, from about 0.1 ppg to about 1 ppg, in other embodiments, from about 1 ppg to about 2 ppg, in other embodiments, from about 2 ppg to about 3 ppg, in other embodiments, from about 3 ppg to about 4 ppg, in other embodiments, from about 4 ppg to about 5 ppg, in other embodiments, from about 5 ppg to about 6 ppg, in other embodiments, from about 6 ppg to about 7 ppg, in other embodiments, from about 7 ppg to about 8 ppg, in other embodiments, from about 8 ppg to about 9 ppg, and in other embodiments, from about 9 ppg to about 10 ppg. In certain embodiments, the microproppant particles may be present in the treatment fluids of the present disclosure in an amount within a range of from about 0.01 ppg to about 0.5 ppg. In one or more embodiments, the microproppant particles may be present in the treatment fluids of the present disclosure in an amount within a range of from about 0.01 ppg to about 0.05 ppg, in other embodiments, from about 0.05 ppg to about 0.1 ppg, in other embodiments, from about 0.1 ppg to about 0.2 ppg, in other embodiments, from about 0.2 ppg to about 0.3 ppg, in other embodiments, from about 0.3 ppg to about 0.4 ppg, and in other embodiments, from about 0.4 ppg to about 0.5 ppg. The concentration of the microproppant particles in the treatment fluid may vary depending on the particular application of the treatment fluid (for example, pre-pad fluid, pad fluid, or spacer fluid). In some embodiments, the treatment fluid (e.g., pre-pad fluid) may not contain any microproppant particles.

In certain embodiments, the systems and methods of the present disclosure may utilize an organic or mineral acid. Examples of organic and mineral acids that may be used according to certain embodiments of the present disclosure include, for example, hydrochloric acid, hydrobromic acid, formic acid, acetic acid, chloroacetic acid, dichloroacetic acid, trichloroacetic acid, methanesulfonic acid, citric acid, maleic acid, glycolic acid, lactic acid, malic acid, oxalic acid, sulfamic acid, succinic acid, urea-stabilized or alkylurea derivatives of the halide acids or of oxyanion acids where the anion is one of C, N, P, S, Se, Si, or similar anions, and any combination thereof. In some embodiments, the acid may be generated from an acid-generating compound. Examples of suitable acid-generating compounds may include, but are not limited to, esters, aliphatic polyesters, orthoesters, poly(orthoesters), poly(lactides), poly(glycolides), poly(ε-caprolactones), poly(hydroxybutyrates), poly(anhydrides), phthalates, terephthalates, ethylene glycol monoformate, ethylene glycol diformate, diethylene glycol diformate, glyceryl monoformate, glyceryl diformate, glyceryl triformate, triethylene glycol diformate, formate esters of pentaerythritol, polyuria or urea polymers, the like, any derivative thereof, and any combination thereof.

The diverting agents used in the methods and systems of the present disclosure may comprise any particulate material capable of altering some or all of the flow of a substance away from a particular portion of a subterranean formation to another portion of the subterranean formation or, at least in part, ensure substantially uniform injection of a treatment fluid (e.g., a treatment fluid) over the region of the subterranean formation to be treated. Diverting agents may, for example, selectively enter more permeable zones of a subterranean formation, where they may create a relatively impermeable barrier across the more permeable zones of the formation (including by bridging one or more fractures), thus serving to divert a subsequently introduced treatment fluid into the less permeable portions of the formation. In certain embodiments, the proppants and/or microproppants used in the methods and systems of the present disclosure may serve a dual purpose as both to prevent fractures from fully closing upon the release of the hydraulic pressure thereby forming conductive channels through which fluids may flow to a well bore and as a diverting agent. Such dual-purpose particulates may be referred to herein as "self-diverting" proppants and/or microproppants (while the proppants and/or microproppants may be self-diverting, the term "self-diverting proppants" will be used hereafter to be inclusive of both proppants and microproppants).

In certain embodiments, diverting effects of the self-diverting proppants may be temporary. For example, a degradable and/or soluble self-diverting proppant may be used such that it degrades or dissolves, for example, after a period of time in the subterranean formation or when contacted by a particular fluid or fluids. Examples of degradable self-diverting proppants that may be suitable for use in certain embodiments of the present disclosure include, but are not limited to, fatty alcohols, fatty acid salts, fatty esters, proteinous materials, degradable polymers, and the like. Suitable examples of degradable polymers that may be used in accordance with the present invention include, but are not limited to, homopolymers, random, block, graft, and star- and hyper-branched polymers. Specific examples of suitable polymers include polysaccharides such as dextran or cellulose; chitin; chitosan; proteins; aliphatic polyesters; poly(lactide); poly(glycolide); poly(ε-caprolactone); poly(hydroxybutyrate); poly(anhydrides); aliphatic polycarbonates; poly(acrylamide); poly(ortho esters); poly(amino acids); poly(ethylene oxide); and polyphosphazenes. Polyanhydrides are another type of degradable polymers that may be suitable for use as degradable diverting agents in the present disclosure. Examples of polyanhydrides that may be suitable include poly(adipic anhydride), poly(suberic anhydride), poly(sebacic anhydride), and poly(dodecanedioic anhydride). Other suitable examples include but are not limited to poly(maleic anhydride) and poly(benzoic anhydride).

Self-diverting proppants may be introduced into the subterranean formation in a treatment fluid and may be included in treatment fluids in any suitable concentration. In certain embodiments, the self-diverting proppants may be provided at the well site in a slurry that is mixed into the base fluid of the treatment fluid as the fluid is pumped into a well bore. In certain embodiments, the concentration of the self-diverting proppants in the treatment fluid may range from about 0.01 lbs per gallon to about 1 lbs per gallon. In certain embodiments, the concentration of the self-diverting proppants in the treatment fluid may range from about 0.1 lbs per gallon to about 0.3 lbs per gallon. In certain embodiments, the total amount of the self-diverting proppants used for a particular stage of a fracturing operation may range from about 1000 lbs to about 5000 lbs. A person of skill in the art with the benefit of this disclosure will recognize the appropriate amount of the self-diverting proppants to use in an application of the present disclosure based on, among other things, the type of formation, the particle size of the diverting agent, the parameters of the fracturing operation, the desired fracture geometries, and the like.

In certain embodiments, the treatment fluids used in the methods and systems of the present disclosure optionally may comprise one or more gelling agents, which may comprise any substance that is capable of increasing the viscosity of a fluid, for example, by forming a gel. In certain embodiments, the gelling agent may viscosify an aqueous fluid when it is hydrated and present at a sufficient concentration. Examples of gelling agents that may be suitable for use in accordance with the present disclosure include, but are not limited to guar, guar derivatives (e.g., hydroxyethyl guar, hydroxypropyl guar, carboxymethyl guar, carboxymethylhydroxyethyl guar, and carboxymethylhydroxypropyl guar ("CMHPG")), cellulose, cellulose derivatives (e.g., hydroxyethyl cellulose, carboxyethylcellulose, carboxymethylcellulose, and carboxymethylhydroxyethylcellulose), biopolymers (e.g., xanthan, scleroglucan, diutan, etc.), starches, chitosans, clays, polyvinyl alcohols, acrylamides, acrylates, viscoelastic surfactants (e.g., methyl ester sulfonates, hydrolyzed keratin, sulfosuccinates, taurates, amine oxides, ethoxylated amides, alkoxylated fatty acids, alkoxylated alcohols, ethoxylated fatty amines, ethoxylated alkyl amines, betaines, modified betaines, alkylamidobetaines, etc.), combinations thereof, and derivatives thereof. The term "derivative" is defined herein to include any compound that is made from one of the listed compounds, for example, by replacing one atom in the listed compound with another atom or group of atoms, rearranging two or more atoms in the listed compound, ionizing the listed compounds, or creating a salt of the listed compound. In certain embodiments, the gelling agent may be "crosslinked" with a crosslinking agent, among other reasons, to impart enhanced viscosity and/or suspension properties to the fluid. The gelling agent may be included in any concentration sufficient to impart the desired viscosity and/or suspension properties to the aqueous fluid. In certain embodiments, the gelling agent may be included in an amount of from about 0.1% to about 10% by weight of the aqueous fluid. In other exemplary embodiments, the gelling agent may be present in the range of from about 0.1% to about 2% by weight of the aqueous fluid. In certain embodiments, the treatment fluids used in the methods and systems of the present disclosure optionally may comprise any number of additional additives, among other reasons, to enhance and/or impart additional properties of the composition. For example, the compositions of the present disclosure optionally may comprise one or more salts, among other reasons, to act as a clay stabilizer and/or enhance the density of the composition, which may facilitate its incorporation into a treatment fluid. In certain embodiments, the compositions of the present disclosure optionally may comprise one or more dispersants, among other reasons, to prevent flocculation and/or agglomeration of the solids while suspended in a slurry. Other examples of such additional additives include, but are not limited to, salts, surfactants, acids, acid precursors, chelating agents, fluid loss control additives, gas, nitrogen, carbon dioxide, surface modifying agents, tackifying agents, foamers, corrosion inhibitors, scale inhibitors, catalysts, clay control agents, biocides, friction reducers, antifoam agents, bridging agents (for example, fibers or expandable particulates), flocculants, $H_2S$ scavengers, $CO_2$ scavengers, oxygen scavengers, lubricants, viscosifiers, breakers, weighting agents, relative permeability modifiers, resins, wetting agents, coating enhancement agents, filter cake removal agents, antifreeze agents (e.g., ethylene glycol), and the like. In one or more embodiments, the bridging agents may be configured to mitigate settling of the proppant or to induce forming proppant nodes, pillars, partial packs, and combinations thereof. A person skilled in the art, with the benefit of this disclosure, will recognize the types of additives that may be included in the fluids of the present disclosure for a particular application.

The methods and systems of the present disclosure may be used during or in conjunction with any subterranean fracturing operation. For example, a treatment fluid may be introduced into the formation at or above a pressure sufficient to create or enhance one or more fractures in at least a portion of the subterranean formation. Such fractures may be "enhanced" where a pre-existing fracture (e.g., naturally occurring or otherwise previously formed) is enlarged or lengthened by the fracturing treatment. Other suitable subterranean operations in which the methods and/or compositions of the present disclosure may be used include, but are not limited to, fracture acidizing, "frac-pack" treatments, and the like.

The treatment fluids used in the methods and systems of the present disclosure may be prepared using any suitable method and/or equipment (e.g., blenders, stirrers, etc.) known in the art at any time prior to their use. In some embodiments, the treatment fluids may be prepared at a well site or at an offsite location. In certain embodiments, an aqueous fluid may be mixed the gelling agent first, among other reasons, in order to allow the gelling agent to hydrate and form a gel. Once the gel is formed, proppants and/or diverting agents may be mixed into the gelled fluid. Once prepared, a treatment fluid of the present disclosure may be placed in a tank, bin, or other container for storage and/or transport to the site where it is to be used. In other embodiments, a treatment fluid of the present disclosure may be prepared on-site, for example, using continuous mixing or "on-the-fly" methods, as described below.

In certain embodiments of the methods and systems of the present disclosure, one or more additional fluids may be introduced into the well bore before, after, and/or concurrently with the treatment fluid, for any number of purposes or treatments in the course of a fracturing operation. Examples of such fluids include, but are not limited to, preflush fluids, pad fluids, pre-pad fluids, acids, afterflush fluids, cleaning fluids, and the like. For example, a pad fluid may be pumped into the well bore prior to the sequential stages of proppant-carrying treatment fluid and clean treatment fluid. In certain embodiments, another volume of pad fluid may be pumped into the well bore between each one of the sequential stages. The "clean" treatment fluid generally comprises a lesser concentration of proppant than the proppant-carrying treatment fluid. In certain embodiments, a "clean" treatment fluid may be a fluid that is substantially free of proppant and/or does not comprise a significant concentration of proppant, although in other embodiments a "clean" treatment fluid may comprise some significant concentration of proppant. A person of skill in the art with the benefit of this disclosure will recognize the appropriate types of additional fluids to use, and when they may be used, in the methods and systems of the present disclosure.

Certain embodiments of the methods and compositions disclosed herein may directly or indirectly affect one or more components or pieces of equipment associated with the preparation, delivery, recapture, recycling, reuse, and/or disposal of the disclosed compositions. For example, and with reference to FIG. 1, the disclosed methods and compositions may directly or indirectly affect one or more components or pieces of equipment associated with an exemplary fracturing system 10, according to one or more embodiments. In certain instances, the system 10 includes a fracturing fluid producing apparatus 20, a fluid source 30, a proppant source 40, and a pump and blender system 50 and resides at the surface at a well site where a well 60 is located. In certain instances, the fracturing fluid producing apparatus 20 combines a gel pre-cursor with fluid (e.g., liquid or substantially liquid) from fluid source 30, to produce a hydrated fracturing fluid that is used to fracture the formation. The hydrated fracturing fluid can be a fluid for ready use in a fracture stimulation treatment of the well 60 or a concentrate to which additional fluid is added prior to use in a fracture stimulation of the well 60. In other instances, the fracturing fluid producing apparatus 20 can be omitted and the fracturing fluid sourced directly from the fluid source 30. In certain instances, the fracturing fluid may comprise water, a hydrocarbon fluid, a polymer gel, foam, air, wet gases and/or other fluids.

The proppant source 40 can include a proppant for combination with the fracturing fluid. The system may also include additive source 70 that provides one or more additives (e.g., gelling agents, weighting agents, and/or other optional additives) to alter the properties of the fracturing fluid. For example, the other additives 70 can be included to reduce pumping friction, to reduce or eliminate the fluid's reaction to the geological formation m which the well is formed, to operate as surfactants, and/or to serve other functions.

The pump and blender system 50 receives the fracturing fluid and combines it with other components, including proppant from the proppant source 40 and/or additional fluid from the additives 70. The resulting mixture may be pumped down the well 60 under a pressure sufficient to create or enhance one or more fractures in a subterranean zone, for example, to stimulate production of fluids from the zone. Notably, in certain instances, the fracturing fluid producing apparatus 20, fluid source 30, and/or proppant source 40 may be equipped with one or more metering devices (not shown) to control the flow of fluids, proppants, and/or other compositions to the pumping and blender system 50. Such metering devices may permit the pumping and blender system 50 can source from one, some or all of the different sources at a given time and may facilitate the preparation of fracturing fluids in accordance with the present disclosure using continuous mixing or "on-the-fly" methods. Thus, for example, the pumping and blender system 50 can provide just fracturing fluid into the well at sometimes, just proppants at other times, and combinations of those components at yet other times.

Figure 2:
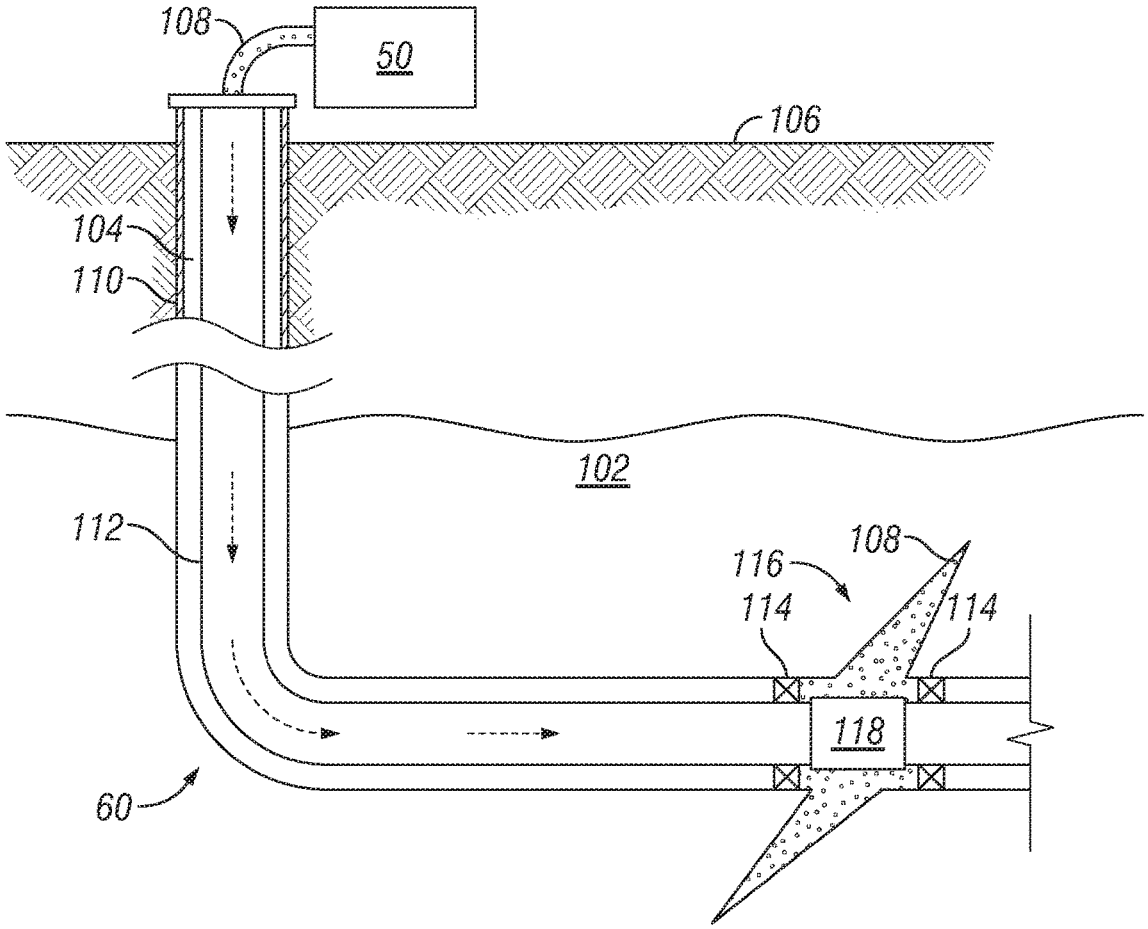
FIG. 2 is a diagram illustrating an example of a subterranean formation in which a fracturing operation may be performed in accordance with certain embodiments of the present disclosure.

FIG. 2 shows the well 60 during a fracturing operation in a portion of a subterranean formation of interest 102 surrounding a well bore 104. The well bore 104 extends from the surface 106, and the fracturing fluid 108 is applied to a portion of the subterranean formation 102 surrounding the horizontal portion of the well bore. Although shown as vertical deviating to horizontal, the well bore 104 may include horizontal, vertical, slant, curved, and other types of well bore geometries and orientations, and the fracturing treatment may be applied to a subterranean zone surrounding any portion of the well bore. The well bore 104 can include a casing 110 that is cemented or otherwise secured to the well bore wall. The well bore 104 can be uncased or include uncased sections. Perforations can be formed in the casing 110 to allow fracturing fluids and/or other materials to flow into the subterranean formation 102. In cased wells, perforations can be formed using shape charges, a perforating gun, hydro jetting and/or other tools.

The well is shown with a work string 112 depending from the surface 106 into the well bore 104. The pump and blender system 50 is coupled to a work string 112 to pump the fracturing fluid 108 into the well bore 104. The work string 112 may include coiled tubing, jointed pipe, and/or other structures that allow fluid to flow into the well bore 104. The work string 112 can include flow control devices, bypass valves, ports, and or other tools or well devices that control a flow of fluid from the interior of the work string 112 into the subterranean zone 102. For example, the work string 112 may include ports adjacent the well bore wall to communicate the fracturing fluid 108 directly into the subterranean formation 102, and/or the work string 112 may include ports that are spaced apart from the well bore wall to communicate the fracturing fluid 108 into an annulus in the well bore between the work string 112 and the well bore wall.

The work string 112 and/or the well bore 104 may include one or more sets of packers 114 that seal the annulus between the work string 112 and well bore 104 to define an interval of the well bore 104 into which the fracturing fluid 108 will be pumped. FIG. 2 shows two packers 114, one defining an uphole boundary of the interval and one defining the downhole end of the interval. When the fracturing fluid 108 is introduced into well bore 104 (e.g., in FIG. 2, the area of the well bore 104 between packers 114) at a sufficient hydraulic pressure, one or more fractures 116 may be created and/or enhanced in the subterranean zone 102. The proppant particulates in the fracturing fluid 108 may enter the fractures 116 where they may remain after the fracturing fluid flows out of the well bore. These proppant particulates may "prop" fractures 116 such that fluids may flow more freely through the fractures 116. As illustrated in FIG. 2, a propellant fracturing tool 118 may be disposed within the well bore 104 between the two packers 114.

Figure 3:
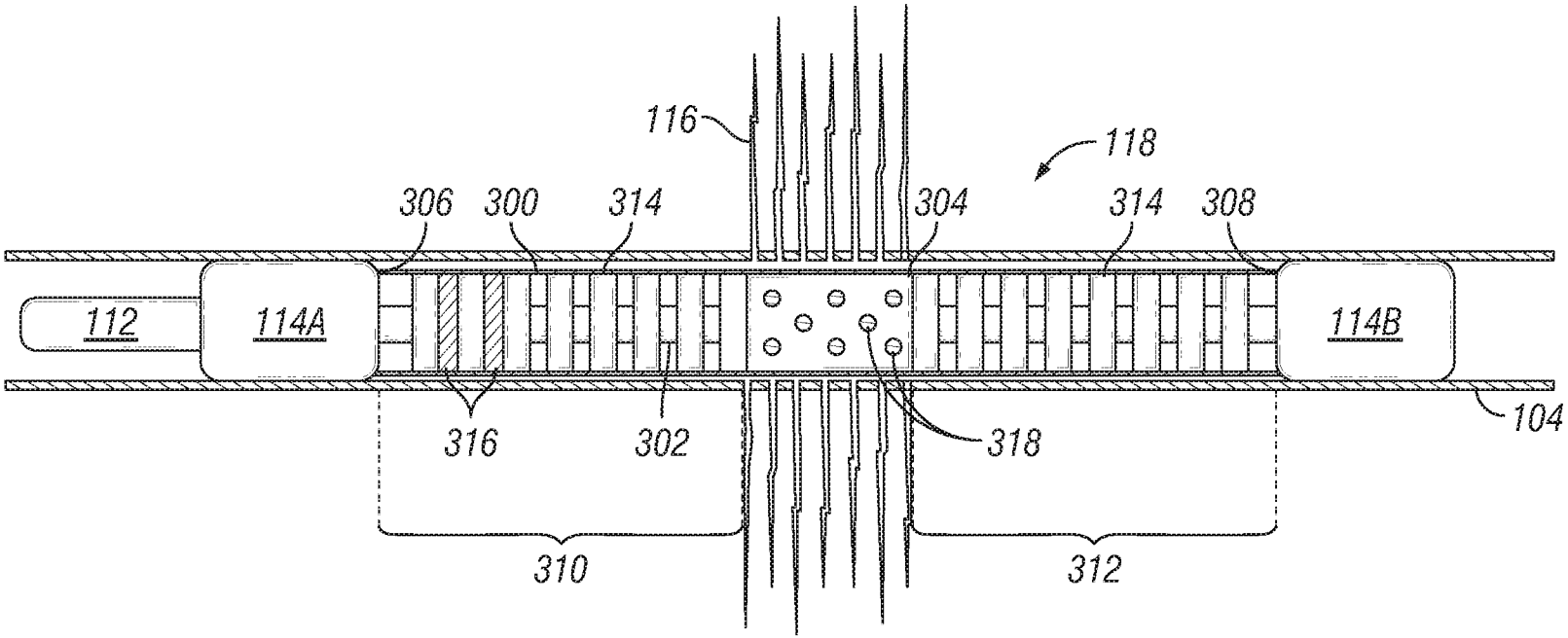
FIG. 3 is a diagram illustrating an example of a propellant fracturing tool in accordance with certain embodiments of the present disclosure.

FIG. 3 illustrates an embodiment of the propellant fracturing tool 118. The propellant fracturing tool 118 may be configured to detonate propellant contained therein to initiate the fractures 116 out into the surrounding formation. In certain embodiment, the propellant fracturing tool 118 may be disposed about the work string 112 and displaced downhole within the well bore 104. In embodiments, the propellant fracturing tool 118 may comprise a housing 300, a fluid conduit 302, and an output section 304. The housing 300 may be any suitable size, height, shape, and combinations thereof. In certain embodiments, the housing 300 may be cylindrical. The housing 300 may comprise any suitable materials such as metals, nonmetals, polymers, ceramics, rubbers, composites, and combinations thereof. As illustrated, a first end 306 of the housing 300 may be coupled to an upper packer 114A, and a second end 308 of the housing 300 may be coupled to a lower packer 114B. The propellant fracturing tool 118 may further comprise a first section 310 and a second section 312 wherein each of the first section 310 and the second section 312 defines a portion of the propellant fracturing tool 118. In embodiments, each of the first section 310 and the second section 312 may comprise a plurality of propellant bands 314. In certain embodiments, there may be an equivalent number of propellant bands 314 within the first section 310 and the second section 312. In one or more embodiments, each one of the plurality of propellant bands 314 may be disposed adjacent to each other within each section. In alternate embodiments, there may be a defined distance of space 316 in between each location of the plurality of propellant bands 314.

In embodiments, each one of the plurality of propellant bands 314 may comprise any substance known in the art that can be ignited to produce a pressure pulse of heat and/or gas. In one or more embodiments, the plurality of propellant bands 314 may be ignited through any suitable means that are mechanical, chemical, electrical, and combinations thereof in nature. In one or more embodiments, the plurality of propellant bands 314 may be provided in any form, including solids (for example, powders, pellets, bands, sleeves, etc.), liquids, gases, semi-solids (for example, gels), and the like. As shown in FIG. 3, the plurality of propellant bands 314 may be in a band-shape disposed within the housing 300 and around the fluid conduit 302. In some embodiments, the plurality of propellant bands 314 may be provided in a composition that comprises a mixture of a binder (for example, polyvinyl alcohol, polyvinylamine nitrate, polyethanolaminobutyne nitrate, polyethyleneimine nitrate, copolymers thereof, and mixtures thereof), an oxidizer (for example, ammonium nitrate, hydroxylamine nitrate, and mixtures thereof), and a crosslinking agent (for example, boric acid). Such propellant compositions may further comprise additional optional additives, including but not limited to stability enhancing or combustion modifying agents (for example, 5-aminotetrazole or a metal complex thereof), dipyridyl complexing agents, polyethylene glycol polymers, and the like. In certain embodiments, the plurality of propellant bands 314 may comprise a polyalkylammonium binder, an oxidizer, and an eutectic material that maintains the oxidizer in a liquid form at the process temperature (for example, energetic materials such as ethanolamine nitrate (ETAN), ethylene diamine dinitrate (EDDN), or other alkylamines or alkoxylamine nitrates, or mixtures thereof). Such propellants may further comprise a mobile phase comprising at least one ionic liquid (for example, an organic liquid such as N,n-butylpyridinium nitrate). In one or more embodiments, each one of the plurality of propellant bands 314 may comprise the same compositions. In one or more embodiments, each one of the plurality of propellant bands 314 may comprise propellent material disposed within a container and coupled to a propellant igniter (for example, a detonation cord).

As illustrated, the plurality of propellant bands 314 may be disposed around the fluid conduit 302. The fluid conduit 302 may be any suitable size, height, shape, and combinations thereof. The fluid conduit 302 may comprise any suitable materials compatible with treatment fluids. In one or more embodiments, the fluid conduit 302 may be coupled to the work string 112. The fluid conduit 302 may be configured to transport a treatment fluid from a surface location (for example, surface 106 in FIG. 2) to the surrounding subterranean formation 102 (referring to FIG. 2). The fluid conduit 302 may comprise holes (not shown) disposed through its thickness at about a location concentric with the output section 304. In one or more embodiments, the treatment fluid may be forced out of the fluid conduit 302 through these holes. In embodiments, the treatment fluid may be injected downhole through the work string 112, through and out the fluid conduit 302, and out the output section 304.

In one or more embodiments, the output section 304 may be a portion of the housing 300. In alternate embodiments, the output section 304 is a separate component (for example, a sleeve) coupled and/or integrated into the housing 300.

The output section 304 may be disposed about any suitable location along the housing 300. In embodiments, the output section 304 may be disposed between the first section 310 and the second section 312. The output section 304 may be configured to provide fluid communication between the subterranean formation 102 (referring to FIG. 2) and the propellant fracturing tool 118. The output section 304 may comprise one or more holes 318 through which the treatment fluid may exit the propellant fracturing tool 118. In embodiments, the one or more holes 318 may be any suitable size, shape, and combinations thereof. In one or more embodiments, the one or more holes 318 may be uniformly dispersed throughout the output section 304. In alternate embodiments, the one or more holes 318 may be dispersed randomly throughout the output section 304.

The methods and systems of the present disclosure, as shown in FIGS. 1-3, may be used to induce and propagate fractures within the subterranean formation 102. In one or more embodiments, the propellant fracturing tool 118 may be disposed downhole through the well bore 104. The propellant fracturing tool 118 may be coupled to the work string 112, and the work string 112 may be run downhole until the propellant fracturing tool 118 reaches an area of interest. In one or more embodiments, the well bore 104 may comprise an open-hole interval, a perforated interval, and combinations thereof at about this area of interest. In one or more embodiments, the upper packer 114A and the lower packer 114B may be actuated to radially expand and seal against the well bore 104. In one or more embodiments, one of the plurality of propellant bands 314 of both the first section 310 and the second section 312 closest to the output section 304 may be detonated simultaneously. Without limitations, detonation may occur through the use of one or more detonation cords, electrical activation, and combinations thereof. In the embodiments, wherein one or more detonation cords are used, the plurality of propellant bands 314 may be coupled to the one or more detonation cords.

A "propellant band stage" will be referred to herein as designating mirroring propellant bands 314 from the first section 310 and the second section 312. For example, detonating a first propellant band stage may include the propellant band 314 of the first section 310 closest to the output section 304 and the propellant band 314 of the second section 312 closest to the output section 304. A second propellant band stage may include the next closest propellant bands 314 from those previously detonated. In one or more embodiments, the detonation of the first propellant band stage may generate a pressure pulse as the resultant produced combustions of both propellant bands 314 are forced to converge and exit out of the propellant fracturing tool 118 through the output section 304. The pressure pulse may be sufficient to form fractures 116 in the surrounding subterranean formation 102. In some embodiments, the output section 304 may comprise plugs (not shown) disposed within the one or more holes 318. The pressure pulse may be sufficient to force out the plugs from the one or more holes 318 and/or to initiate fractures 116. In alternate embodiments, the detonation of a second propellant band stage may be required to initiate the fractures 116 after forcing the plugs out of the one or more holes 318. In one or more embodiments, a first treatment fluid may be injected downhole after the detonation of the first or second propellant band stage to be placed into the created fractures 116. In embodiments, the first treatment fluid may comprise reactive agents configured to etch or form channels extending the established fractures 116. In one or more embodiments, the reactive agents may have a rate of reaction slower or delayed in comparison to conventional reactive agents (for example, hydrochloric acid). For example, the reactive agents may have a rate of reaction, or releases acid at a rate, that is several orders of magnitude lower than hydrochloric acid when the reactive agents contact carbonate-rich rock. In one or more embodiments, the reactive agents may be acid or a component that releases acid on a delayed basis. In certain embodiments, the reactive agents may remain active for hours, enabling the treatment fluid to be placed deeper into the created fracture system. In embodiments, reservoir temperature and concentration of the reactive agent may affect the reaction rate (for example, high temperatures or high concentrations may increase the reaction rate). Without limitations, an exemplary reactive agent may comprise N-phosphonomethyl iminodiacetic acid (PMIDA).

The first treatment fluid may traverse down the work string 112, through the fluid conduit 302, out the output section 304, and into the fractures 116 of the subterranean formation 102. In one or more embodiments, the detonation of a subsequent propellant band stage may occur, thereby generating another pressure pulse. In these embodiments, the generated pressure pulse may force the first treatment fluid to penetrate further into the subterranean formation 102 thereby extending the fracture length and/or complexity of the fractures 116. In one or more embodiments, a second treatment fluid may be injected downhole after the detonation of the subsequent propellant band stage. The second treatment fluid may comprise microproppants, proppants, and combinations thereof to be deposited within the fractures 116 in order to prop the fractures 116 to remain open. In one or more embodiments, the detonation of propellant band stages may be repeated until the plurality of propellant bands 314 have been detonated. In these embodiments, there may be a time delay between each detonation. Without limitations, the time delay may be from about 1 second to about 5 minutes.

In one or more embodiments, treatment fluid may be injected after each detonation repeatedly to deposit more proppants within the existing fractures 116 and to extend or propagate the existing fractures 116. In each subsequent injection, the treatment fluid may comprise larger microproppant and/or proppant particles than the prior injection treatment. For example, and without limitation, the second treatment fluid may comprise microproppants, the next treatment fluid may comprise proppants sized at 100-mesh, and the following treatment fluid may comprise proppants sized at 30/50-mesh or 40/70-mesh. In one or more embodiments, the injection flow rates may be slow, such as from about 0.1 bpm to about 20 bpm. In alternate embodiments, the injection stages may occur concurrently with the detonation stages. Treatment fluid may be continuously injected as the propellant band stages are detonated periodically.

While not specifically illustrated herein, the disclosed methods and compositions may also directly or indirectly affect the various downhole equipment and tools that may come into contact with the treatment fluids during operation. Such equipment and tools may include, but are not limited to, well bore casing, well bore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other well bore isolation devices, or components, and the like. Any of these components may be included in the systems generally described above and depicted in FIGS. 1-3.

To facilitate a better understanding of the present disclosure, the following examples of certain aspects of certain embodiments are given. The following examples are not the only examples that could be given according to the present disclosure and are not intended to limit the scope of the disclosure or claims.

Example 1

Figure 4A:
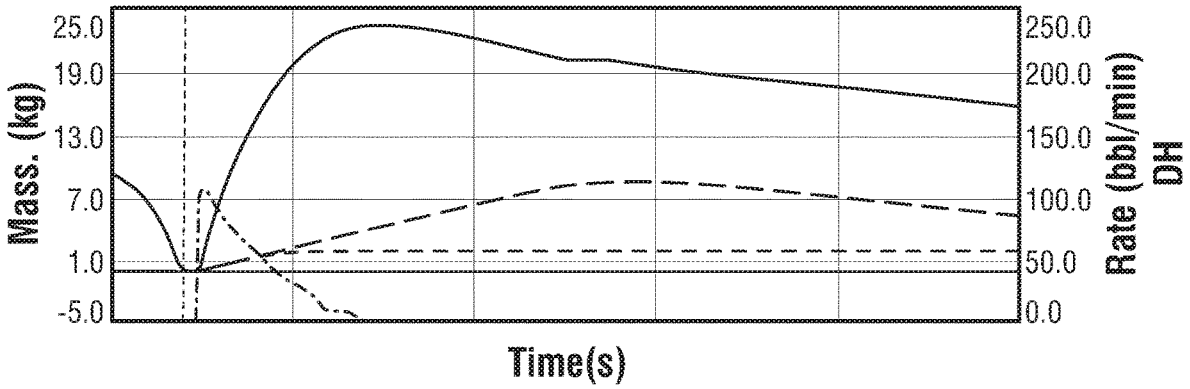
FIGS. 4A-4C are graphs illustrating an example of a singular pressure pulse in accordance with certain embodiments of the present disclosure.
Figure 4B:
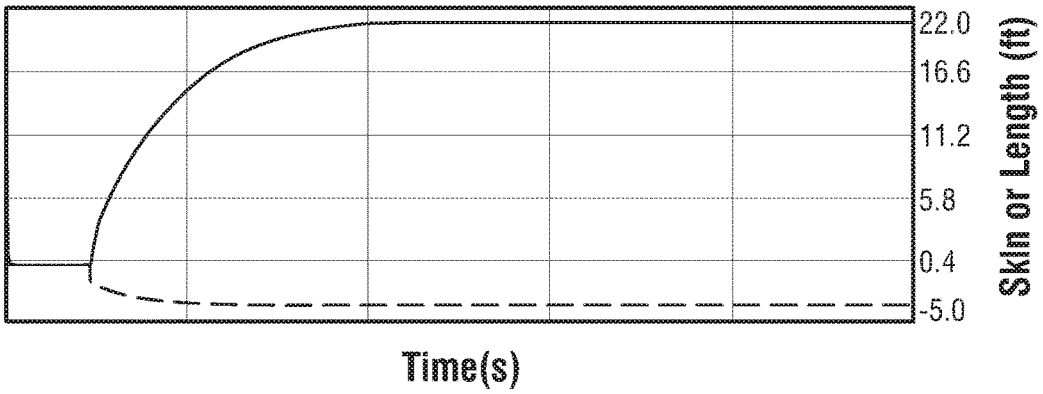
Figure 4C:
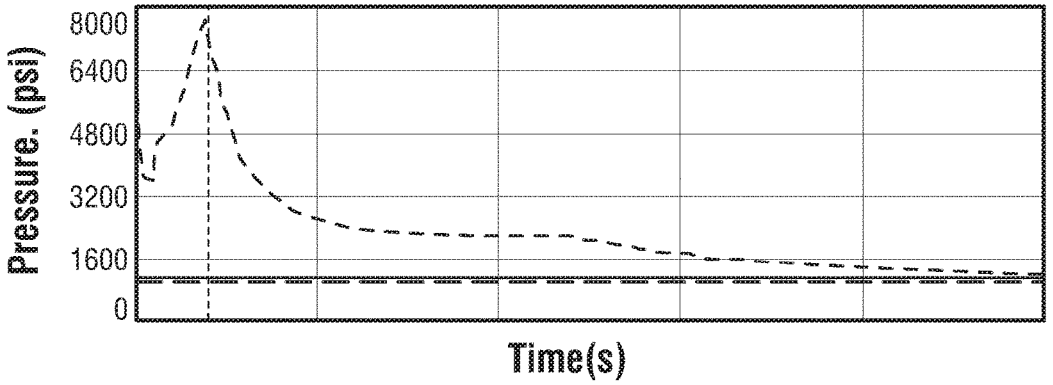

FIGS. 4A-4C illustrate model simulations of a singular pressure pulse created by an example of the propellant fracturing tool 118 (referring to FIG. 3). FIG. 4A depicts a graph of the burn rate of the mass of a propellant material over a period of time. FIG. 4B depicts a graph of the growth of the fracture length over the same period of time. FIG. 4C depicts a graph of the pressure released as a result of the burning propellant material within that period of time. FIGS. 4A-4C provide that for the singular pressure pulse produced, the resultant fracture length is 22 ft from a release of about 8 kpsi of pressure.

Example 2

Figure 5A:
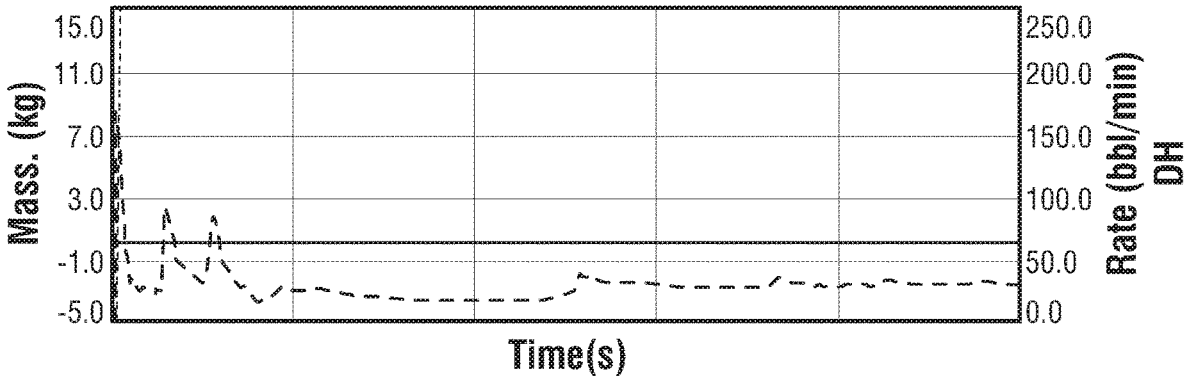
FIGS. 5A-5C are graphs illustrating an example of multiple pressure pulses in accordance with certain embodiments of the present disclosure.
Figure 5B:
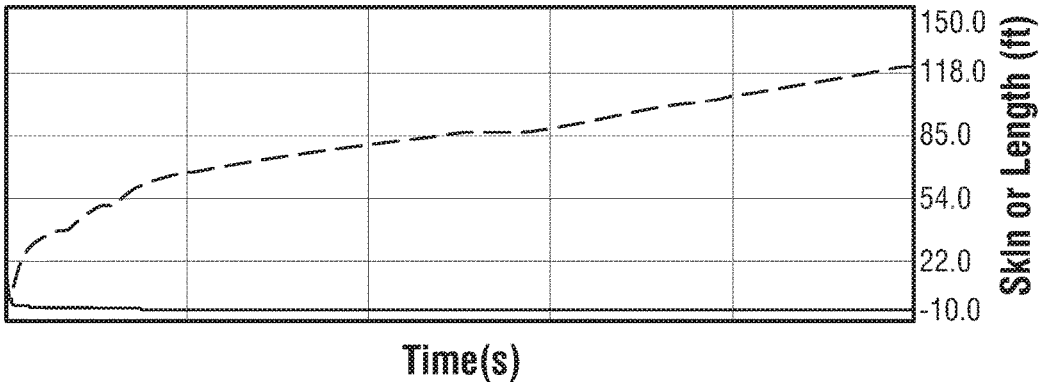
Figure 5C:
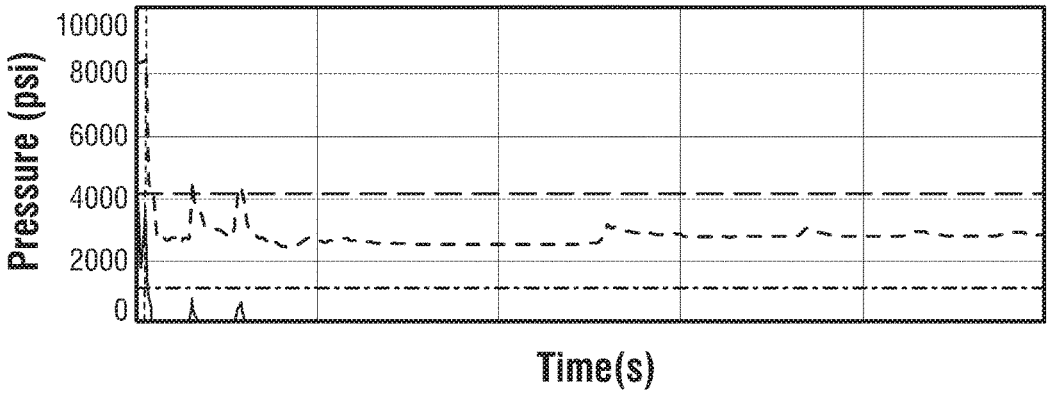

FIGS. 5A-5C illustrate model simulations of multiple pressure pulses created by an example of the propellant fracturing tool 118 (referring to FIG. 3). FIG. 5A depicts a graph of the burn rates of the masses of propellant material over a period of time. FIG. 5B depicts a graph of the growth of the fracture length over the same period of time. FIG. 5C depicts a graph of the pressure released as a result of the burning propellant material within that period of time. FIGS. 5A-5C provide that for the three separate pressure pulses produced, the resultant fracture length is 118 ft. The pressure produced from the first propellant mass is about 8.25 kpsi, the second propellant mass is about 4 kpsi, and the third propellant mass is about 4 kpsi. In this example, each pressure pulse is separated by a time period of about 1 second. In comparison to Example 1, utilizing multiple pressure pulses can increase the fracture length of a potential fracture significantly.

An embodiment of the present disclosure is a propellant fracturing tool comprising: a housing, wherein the housing comprises a first section and a second section, wherein both the first section and the second section comprise a plurality of propellant bands, a fluid conduit, and an output section, wherein the output section is disposed in between the first section and the second section.

In one or more embodiments described in the preceding paragraph, a first end of the housing is coupled to an upper packer, wherein a second end of the housing is coupled to a lower packer. In one or more embodiments described above, the propellant fracturing tool is coupled to a work string, wherein the fluid conduit is fluidly coupled to the work string. In one or more embodiments described above, each one of the plurality of propellant comprises a band-shape disposed within the housing and around the fluid conduit. In one or more embodiments described above, the output section comprises one or more holes disposed uniformly along the output section. In one or more embodiments described above, there is a defined distance of space in between each set of adjacent propellant bands. In one or more embodiments described above, each one of the plurality of propellant bands is comprises propellent material disposed within a container and coupled to a propellant igniter.

Another embodiment of the present disclosure is a method comprising: disposing a propellant fracturing tool downhole into a well bore, wherein the propellant fracturing tool comprises a housing, a fluid conduit, and an output section, introducing a fracturing fluid into a work string coupled to the fluid conduit to pressurize and set an upper packer and a lower packer against the well bore, thereby isolating an interval for propellant fracturing, wherein the propellant fracturing tool is disposed between the upper packer and the lower packer, detonating sequentially a plurality of propellant band stages to produce one or more fractures, wherein each one of the plurality of propellant band stages comprises a propellant band from both a first section and a second section of the housing, introducing sequentially a series of treatment fluids into a well bore penetrating at least a portion of a subterranean formation, wherein the sequential introduction of the series of treatment fluids occurs between the sequential detonation of the plurality of propellant band stages, and depositing at least a portion of the treatment fluids in at least a portion of the subterranean formation.

In one or more embodiments described in the preceding paragraph, the one or more fractures comprise one or more microfractures. In one or more embodiments described above, the series of treatment fluids comprise a first treatment fluid that comprises reactive agents and a base fluid, a second treatment fluid that comprises a plurality of micro-proppants, and one or more subsequent treatment fluids that comprise a plurality of proppants. comprising increasingly larger particle sizes. In one or more embodiments described above, the reactive agents comprise N-phosphonomethyl iminodiacetic acid (PMIDA). In one or more embodiments described above, the series of treatment fluids further comprises bridging agents configured to mitigate settling of the proppant or to induce forming proppant nodes, pillars, partial packs, and combinations thereof. In one or more embodiments described above, at least one of the one or more subsequent treatment fluids comprise the plurality of proppants sized at 100-mesh, 40/70-mesh, and 30/50-mesh. In one or more embodiments described above, the series of treatment fluids are introduced at an injection flow rate of about 0.1 bpm to about 20 bpm. In one or more embodiments described above, detonating sequentially a plurality of propellant band stages comprises detonating a first propellant band stage, detonating a second propellant band stage, and detonating one or more subsequent propellant band stages. In one or more embodiments described above, the first propellant band stage comprises a propellant band of the first section disposed closest to the output section and a propellant band of the second section disposed closest to the output section. In one or more embodiments described above, detonating the first propellant band stage comprises of forcing plugs out of one or more holes disposed throughout the output section. In one or more embodiments described above, detonating the second propellant band stage comprises of initiating the one or more fractures. In one or more embodiments described above, wherein there is a time delay between the sequential detonation of the plurality of propellant band stages. In one or more embodiments described above, the time delay is from about 1 second to about 5 minutes.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method comprising:

disposing a propellant fracturing tool downhole into a well bore, wherein the propellant fracturing tool comprises a housing, a fluid conduit, and an output section;

introducing a fracturing fluid into a work string coupled to the fluid conduit to pressurize and set an upper packer and a lower packer against the well bore, thereby isolating an interval for propellant fracturing, wherein the propellant fracturing tool is disposed between the upper packer and the lower packer;

detonating sequentially a plurality of propellant band stages to produce one or more fractures, wherein each one of the propellant band stage comprises one of the plurality of propellant bands in the first section and one of the plurality of propellant bands in the second section that mirrors the position of the one of the plurality of propellant bands in the first section;

introducing sequentially a series of treatment fluids into a well bore penetrating at least a portion of a subterranean formation, wherein the sequential introduction of the series of treatment fluids occurs between the sequential detonation of the plurality of propellant band stages; and depositing at least a portion of the treatment fluids in at least a portion of the subterranean formation.

2. The method of claim 1, wherein the one or more fractures comprise one or more microfractures.

3. The method of claim 1, wherein the series of treatment fluids comprise:

a first treatment fluid that comprises reactive agents and a base fluid;

a second treatment fluid that comprises a plurality of microproppants; and one or more subsequent treatment fluids that comprise a plurality of proppants.

4. The method of claim 3, wherein the reactive agents comprise N-phosphonomethyl iminodiacetic acid (PMIDA).

5. The method of claim 3, wherein the series of treatment fluids further comprises one or more bridging agents.

6. The method of claim 3, wherein the one or more subsequent treatment fluids comprises at least a first subsequent treatment fluid and a second subsequent treatment fluid, wherein the plurality of proppants in the second subsequent treatment fluid have particle sizes larger than the plurality of proppants in the first subsequent treatment fluid.

7. The method of claim 1, wherein the series of treatment fluids are introduced at an injection flow rate of about 0.1 bpm to about 20 bpm.

8. The method of claim 1, wherein detonating sequentially a plurality of propellant band stages comprises:

detonating a first propellant band stage;

detonating a second propellant band stage; and detonating one or more subsequent propellant band stages.

9. The method of claim 8, wherein the first propellant band stage comprises a propellant band of the first section disposed closest to the output section and a propellant band of the second section disposed closest to the output section.

10. The method of claim 9, wherein detonating the first propellant band stage comprises of forcing plugs out of one or more holes disposed throughout the output section.

11. The method of claim 8, wherein detonating the second propellant band stage comprises initiating the one or more fractures.

12. The method of claim 1, wherein there is a time delay between the sequential detonation of the plurality of propellant band stages.

13. The method of claim 12, wherein the time delay is from about 1 second to about 5 minutes.

14. A propellant fracturing tool, comprising:

a housing, wherein the housing comprises a first section and a second section, wherein both the first section and the second section comprise a plurality of propellant bands, wherein each one of the plurality of propellant comprises a band-shape disposed within the housing and around the fluid conduit, wherein the housing comprises a plurality of propellant band stages, wherein each propellant band stage comprises one of the plurality of propellant bands in the first section and one of the plurality of propellant bands in the second section that mirrors the position of the one of the plurality of propellant bands in the first section;

a fluid conduit; and an output section, wherein the output section is disposed in between the first section and the second section.

15. The propellant fracturing tool of claim 14, wherein a first end of the housing is coupled to an upper packer, wherein a second end of the housing is coupled to a lower packer.

16. The propellant fracturing tool of claim 14, wherein the propellant fracturing tool is coupled to a work string, wherein the fluid conduit is fluidly coupled to the work string.

17. The propellant fracturing tool of claim 14, wherein the output section comprises one or more holes disposed uniformly along the output section.

18. The propellant fracturing tool of claim 14, wherein there is a defined distance of space in between each set of adjacent propellant bands.

19. The propellant fracturing tool of claim 14, wherein each one of the plurality of propellant bands comprises propellent material disposed within a container and coupled to a propellant igniter.

* * * * *